United States Patent [19]

Audesse et al.

[11] 3,947,225

[45] Mar. 30, 1976

[54] PHOTOFLASH LAMP

[75] Inventors: Emery G. Audesse; Donald E. Armstrong, both of Williamsport; Ronald E. Sindlinger, Muncy, all of Pa.

[73] Assignee: GTE Sylvania Incorporated, Montoursville, Pa.

[22] Filed: Mar. 31, 1975

[21] Appl. No.: 563,933

[52] U.S. Cl. ..... 431/95 R
[51] Int. Cl.[2] ..... F21K 5/02
[58] Field of Search ..... 431/93–95

[56] References Cited

UNITED STATES PATENTS

| | | | |
|---|---|---|---|
| 3,506,385 | 4/1970 | Weber et al. | 431/95 |
| 3,771,941 | 11/1973 | Audesse et al. | 431/93 |
| 3,832,124 | 8/1974 | Loughridge et al. | 431/93 |
| 3,897,196 | 7/1975 | Saunders et al. | 431/95 |

*Primary Examiner*—Carroll B. Dority, Jr.
*Attorney, Agent, or Firm*—Edward J. Coleman

[57] ABSTRACT

A photoflash lamp having an envelope comprised of a lead-containing glass having a low coefficient of thermal expansion and a pair of filament-supporting lead-in wires secured to the glass envelope by means of a graded seal having a lead-free intermediate expansion glass disposed between the envelope and lead-in wires. The lead-in wires are composed of an iron-nickel-cobalt alloy. The intermediate expansion glass may be in the form of a bead having its midportion between the lead-in wires stretched to protrude toward the filament to prevent post-ignition short circuits.

13 Claims, 2 Drawing Figures

PHOTOFLASH LAMP

BACKGROUND OF THE INVENTION

This invention relates to the manufacture of photoflash lamps and, more particularly, to flashlamps containing filament-supporting lead-in wires.

Photoflash lamps generate an actinic light output by the burning of an energetic fuel, such as finely shredded zirconium, hafnium or aluminum metal foil, in a combination supporting atmosphere, such as oxygen. In some of the tubular electrically ignitable photoflash lamps presently manufactured, the ignition means comprises a pair of lead-in wires sealed through one end of the tubular glass envelope. A tungsten filament is mounted across the inner ends of the two lead-in wires with the ends of the wires at their junctions with the filament being coated with a primer material, such as a powdered zirconium mixture. Typically, the envelope is comprised of G-1 type soft glass having a coefficient of thermal expansion within the range of 85 to 95 $\times 10^{-7}$ per °C between 20°C and 300°C, and the lead-in wires are formed of a metal having a similar coefficient of thermal expansion so as to provide a match seal.

When battery power is applied to the external projecting portions of the two lead-in wires, the filament glows to incandescence, causing the primer material to ignite, which in turn ignites the finely shredded metallic combustible in the lamp envelope and, thus, flashes the lamp. During lamp flashing, the glass envelope is subjected to severe thermal and mechanical shock due to hot globules of metal oxide impinging on the walls of the lamp. As a result, cracks and crazes occur in the glass and, at higher internal pressures, containment becomes unlikely. In order to reinforce the glass envelope and improve its containment capability, it has been common practice to apply a protective lacquer coating on the lamp envelope by means of a dip process. To build up the desired coating thickness, the glass is generally dipped a number of times into a lacquer solution containing a solvent and a selected resin, typically cellulose acetate. After each dip, the lamp is dried to evaporate the solvent and leave the desired coating of cellulose acetate, or whatever other plastic resin is employed.

In the continuing effort to improve light output, higher performance flashlamps have been developed which contain higher combustible fill weights per unit of internal envelope volume along with higher fill gas pressures. In addition, the combustible material may be one of the more volatile types, such as hafnium. Such lamps, upon flashing, appear to subject the glass envelopes to more intense thermal shock effects, and thus require stronger containment vessels. One approach to this problem has been to employ a hard glass envelope, such as the borosilicate glass envelope described in U.S. Pat. No. 3,506,385, along with a protective dip coating. More specifically, this patent describes an electrically ignitable lamp having in-leads of a metal alloy such as Kovar secured by an internal expansion match seal in a lead-free glass envelope having a coefficient of thermal expansion in the range of 40 to 50 $\times 10^{-7}$ per °C. Type 7052 glass is mentioned as typical. The patent imposes a minimum of $40 \times 10^{-7}$ per °C on the coefficient of thermal expansion of the glass to assure the necessary match seal with the Kovar inleads. Further, it is theorized that glass in this thermal expansion range provides a more beneficial mode of fracture which results in a delay in crack time after flashing. More specifically, fracture of the glass is delayed to a time when the pressure in the lamp has been reduced to a point where containment is more readily assured.

As described in U.S. Pat. No. 3,832,124, assigned to the present assignee, it has been discovered that by using glasses having an even lower thermal expansion than that specified in the aforementioned U.S. Pat. No. 3,506,385 the flashlamp envelope can be made even more resistance to thermal shock and thereby delay crack time even further. Alternatively, the use of lower thermal expansion glass provides a lamp capable of higher thermal loadings, as the glass surface stresses are proportional to the thermal expansion of the glass. In particular, we have found that glasses having a coefficient of thermal expansion within the range of 30 to 40 $\times 10^{-7}$ per °C between 0°C and 300°C are particularly suitable for improving the containment of flashlamp envelopes. Hereinafter, such glass will be referred to as "low-expansion glass". Of course, fused quartz has a very low coefficient of thermal expansion, in the order of $4 \times 10^{-7}$ per °C, but it is somewhat costly for this application.

In attempting to use a low-expansion glass envelope in flashlamp applications, however, a sealing problem arises as many of the metals typically used for ignition structures have a substantially higher coefficient of thermal expansion than the glass and, therefore, are not suitable for providing a match seal. In the above-referenced U.S. Pat. No. 3,832,124, which describes a percussive type flashlamp having a depending primer tube assembly for ignition, this problem is met by employing a compression seal. That is the metal primer tube is shaped so that it bears against the exterior surface of the glass envelope of lower thermal expansion, whereby the seal area of the glass is placed under compression upon cooling from the sealing process. Under a compressive strain, glass is made considerably stronger; hence, even though the metals are mismatched with respect to thermal expansion, a strong seal results. The low-expansion glasses suggested in that patent are Corning types 7740, 7760, 7250 and 7070, and the primer tube metals include 42 nickel-iron alloy and alloys of iron, nickel and cobalt, such as Kovar.

Another approach to the metal-to-glass mismatch problem is to employ a graded seal, such as described in U.S. Pat. No. 3,771,941, assigned to the present assignee. This last-mentioned patent describes a percussive flash lamp having a low-expansion glass, such as Corning type 7070 hard glass, sealed to a Kovar primer tube by means of a graded seal having an intermediate expansion glass, such as Corning type 7050, disposed between the envelope and primer tube.

In addition to the sealing difficulties encountered with low-expansion glasses, another major problem is workability. A common characteristic of the aformentioned hard glasses is a relatively narrow temperature working range. Accordingly, such glasses are more difficult to draw, and thus, relatively expensive. Further, such glasses are more difficult to work with conventional sealing methods during the lamp-making process, thereby causing increased shrinkage in the factory.

SUMMARY OF THE INVENTION

In view of the foregoing, it is an object of the present invention to economically provide a photoflash lamp having an improved containment vessel.

Another object of the invention is to provide an improved glass-to-metal seal for a flashlamp.

A principal object is to economically provide an electrically ignitable photoflash lamp having a low expansion glass envelope with improved working characteristics and a strong glass-to-metal seal between the envelope and lead-in wires.

These and other objects, advantages and features are attained, in accordance with the invention, by sealing a body of lead-free intermediate expansion glass between a lead-containing low expansion glass envelope and the higher expansion metal lead-in wires. More specifically, we have discovered that the addition of a small percentage of lead, say on the order of 1 to 6 percent PbO by weight, to a low expansion glass composition appears to significantly improve the working characteristics of the glass without impairing the thermal characteristics and containment capabilities of the glass with respect to photoflash applications. As noted in U.S. Pat. No. 3,506,385, column 7, lines 68–71, however, glasses containing substantial amounts of PbO, such as Nonex Glass 7720 (which contains about 6 percent PbO), react with iron-containing inlead wires during sealing, producing bubbles and unacceptable leaky seals. Accordingly, such glasses often require that lead-in wires to be sealed through them be molybdenum, tungsten or other materials generally less desirable for outer lead wires of photoflash lamps than certain other metals due to their high rigidity, brittleness and cost. In accordance with the invention, therefore, we have also determined that a flashlamp envelope having the easier drawing and improved containment properties of a low-expansion, lead-containing glass, such as Nonex, can be employed with a more suitable lead-in wire material, such as the iron-nickel-cobalt alloys of Kovar or Rodar, if a lead-free intermediate expansion glass, such as Corning type 7750, is sealed or beaded to the lead-in wires and then sealed to one end of the envelope. Such a construction not only provides a graded seal between the lead-in wires and glass envelope which avoids the creation of high stresses at the glass-to-metal interface, but it also isolates the iron-containing lead-in wires from the lead-containing glass envelope to prevent leaky seals due to undesired reaction therebetween.

According to another embodiment, a further aspect of the invention may be provided by stretching or reshaping the bead of intermediate expansion glass which is sealed to the lead-in wires to provide a separator between the leads for assuring an open circuit condition after the bulb is flashed. More specifically, the insulating bead of intermediate expansion glass is shaped between the lead-in wires to protrude toward the filament, so as to provide at minimum cost a reliable means for preventing post-ignition short circuits between the lead-in wires. In this manner, the need for additional separator beads and/or sleeves within the lamp envelope is avoided, and the internal valume of the lamp is maximized to thereby enhance the efficiency of combustion for a given lamp size. Stated another way, this construction contributes toward obtaining improved light output from smaller size lamps.

BRIEF DESCRIPTION OF THE DRAWINGS

This invention will be more fully described hereinafter in conjunction with the accompanying drawings, in which.

DESCRIPTION OF PREFERRED EMBODIMENT

Figure 1:
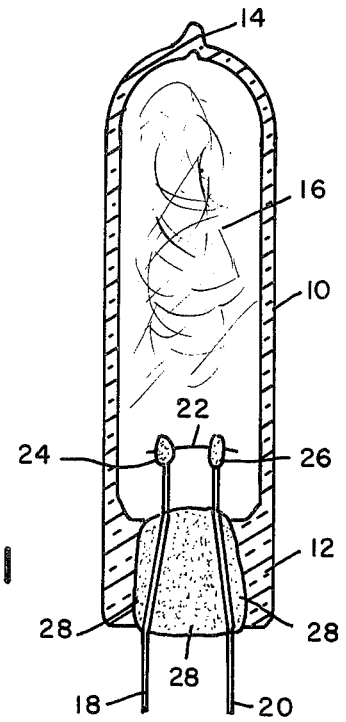
FIG. 1 is an enlarged sectional elevation of an electrically ignitable photoflash lamp having a graded seal between the envelope and lead-in wires according to the invention.

Referring to FIG. 1 an electrically ignitable photoflash lamp is shown comprising an hermetically sealed, lighttransmitting envelope 10 of glass tubing having a press 12 defining one end thereof and an exhaust tip 14 defining the other end thereof. A quantity of filamentary combustible material 16, such as shredded zirconium or hafnium foil, is located within the lamp envelope. The envelope is also provided with a filling of combustion-supporting gas, such as oxygen, at a pressure of several atmospheres. The exterior surface of the glass envelope 10 is covered with a suitable plastic coating, such as cellulose acetate. Typically, the lamp envelope has an internal diameter of less than one-half inch, and an internal volume of less than 1 cc., although the present invention is equally suitable for application to larger lamp sizes.

The ignition structure comprises a pair of lead-in wires 18 and 20 extending through and sealed into the press 12. A filament 22 spans the inner ends of the lead-in wires, and beads of primer 24 and 26 are located on the inner ends of the lead-in wires 18 and 20, respectively, at their junctions with the filament.

When battery current is applied to the external projecting portions of the two lead-in wires the filament 22 glows to incandescence, causing the primer material 24, 26 to ignite, which in turn ignites the finely shredded metallic combustible material 16 in the lamp to produce the desired flash of light output.

In accordance with the invention the glass envelope 10 is selected to be a low expansion glass, i.e. with a coefficient of thermal expansion between about 30 to $40 \times 10^{-7}$ per °C between 0°C and 300°C, which contains a small proportion of lead, say in the range of from about 1 to 6 percent by weight. For example, a glass that has been found particularly suitable for forming envelope 10 is Corning Glass Works type 7720 (known as Nonex glass), which has a mean coefficient of thermal expansion of about $36 \times 10^{-7}$ per °C, between 0°C and 300°C, and a composition which is approximately: 73% $SiO_2$, 2% $Al_2O_3$, 15% $B_2O_3$, 4% $Na_2O$ and 6% PbO.

The lead-in wires 18 and 20 are preferably composed of a metal alloy such as that commercially known as Kovar or Rodar, which has a mean coefficient of thermal expansion of about $50 \times 10^{-7}$ per °C, between 25°C and 300°C, and a composition which is approximately: 54% Fe, 29% Ni, 17% Co, <0.5% Mn, <0.2% Si, and <0.06% C.

Further in accordance with the invention, the lead-in wires 18 and 20 are sealed in the end of the lamp envelope by means of a graded seal including a bead 28 of pressed and sintered intermediate expansion glass. Preferably, bead 28 is formed of a glass having a mean coefficient of thermal expansion of about $40.5 \times 10^{-7}$ per °C between 0°C and 300°C, such as Corning Glass Works type 7750 glass, which has a composition of approximately 68% $SiO_2$, 2% $Al_2O_3$, 26% $B_2O_3$, 0.5% $Li_2O$ and 3.5% $Na_2O$ and/or $K_2O$.

To provide a strong glass-to-metal seal, 7750 glass powder is heated and pressed into a doughnut-shaped preform comprising the bead 28. This doughnut shaped bead 28 is then slipped over the spaced apart lead-in wires 18 and 20, and the assembly is rotated over the flame of a torch to seal the glass bead 28 to the lead-in wires. Thereafter, the 7720 glass envelope 10 is sealed about the 7750 glass bead in the same manner. Thereafter, the heated seal is pressed at 12. The choice of 7750 glass, with an expansion of 40.5 is reasonably critical due to its suitable match to both the Kovar or Rodar leads 18 and 20, with an expansion of 50, and the 7720 glass envelope, with an expansion of 36. The resulting graded seal avoids the creation of high stresses at the glass-to-metal interface and cracking of the seal. In addition, the lead-free composition of the 7750 glass provides isolation between the lead-containing 7720 glass and the iron-containing Kovar or Rodar leads to prevent undesired reaction therebetween.

Figure 2:
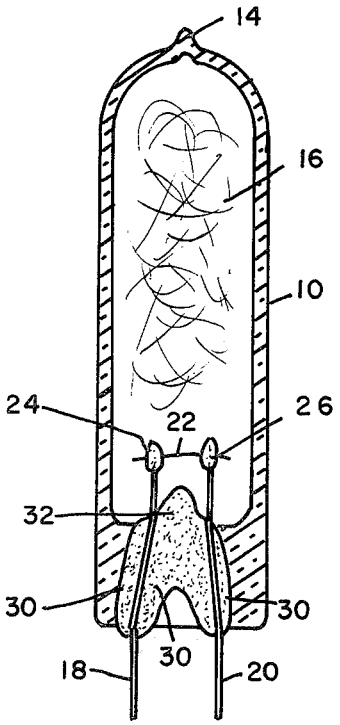
FIG. 2 is an enlarged sectional elevation of an electrically ignitable photoflash lamp having a graded seal provided by a glass bead which is stretched to protrude between the lead-in wires toward the filament.

Accordingly, a strong glass-to-metal seal is provided between a low-expansion, but easier to draw, glass envelope and the lead-in wires to provide a significantly improved containment vessel for a flashlamp. More specifically, whereas 0010 type soft glass (expansion of 93) and 7052 hard glass (expansion of 46) used on prior art flashlamps have thermal stress resistances of about 19°C and 41°C, respectively, the thermal stress resistance of 7720 glass (expansion of 36) is about 49°C. By definition, thermal stress resistance in °C is the temperature differential between the two surfaces of a tube or constrained plate that will cause a tensile stress of 1000 pounds per square inch on the cooler surface. Hence, the hermetically sealed, low-expansion glass envelope of FIG. 2 provides a higher resistance to thermal shock, thereby permitting greater loading of the lamp with a combustible material and oxygen to provide increased light output. In addition, however, the PbO contained in the 7720 glass provides improved working characteristics during the production process, thereby significantly reducing factory shrinkage.

FIG. 2 illustrates a further aspect of the invention wherein a preferred graded seal construction is shown which is designed not only to provide an improved seal to an easier drawing, lower expansion glass, but also to prevent post-ignition short circuits across the lead-in wires. Such a feature is required for the proper operation of certain flash sequencing circuitry for controlling linear arrays of flash lamps. For example, in one presently marketed photoflash array application, if a short circuit occurs between the melted lead-in wires in the first (or subsequent) lamp of the array to be flashed by the sequencing circuitry, the entire array of lamp is rendered useless. Previous approaches for providing this function include those described in U.S. Pat. No. 3,816,054, wherein a glass bead inside the lamp envelope supports the lead-in wires in a spaced apart relation with a glass sleeve disposed about a portion of one of the lead-in wires as an insulating shield, and application Ser. No. 444,343, filed Feb. 21, 1974, now U.S. Pat. No. 3,897,196 and assigned to the present assignee, which employs a stretched bead within the lamp envelope. FIG. 2 employs the stretched bead concept of this last-mentioned reference and incorporates it in the graded seal construction. More specifically, a glass bead 30 of the same composition and thermal expansion coefficient as bead 28 (of FIG. 1) is shaped by a distortion of its midportion 32 between the lead-in wires to protrude toward the filament 22. The remaining elements of the lamp of FIG. 2 are the same as the like-numbered elements of the lamp of FIG. 1.

Upon ignition of the flashlamp the intense heat of the combustion process causes the top portion of the lead-in wires 18 and 20 to melt away down to the top surface of the glass bead 30. The upwardly protruding portion 32 of the glass bead, however, serves to isolate the molten portions of the two lead-in wires so that a short circuit conductive path is not inadvertently effected by a chance fusion of the two melting wires subsequent to flashing.

Accordingly, the construction of FIG. 2 permits the elimination of separate glass beads and/or sleeves within the lamp envelope, while still providing protection against post-ignition shorts. The attendant advantages of this feature may best be appreciated by considering disadvantages of the glass insulating sleeve approach. Firstly, the relatively massive bead-sleeve ignition structure substantially decreases the internal volume of the lamp, a factor which is of considerable importance in the currently popular subminiature lamp sizes having internal volumes much less than one cubic centimeter. The presence of the bead sleeve structure results in a higher initial pressure and also causes difficulty in obtaining good fill distribution within the envelope. In addition, it has been determined through many tests that the relatively massive beaded and bead-sleeve inlead structures in subminiature flashlamps cause a decrease in flash illumination efficiency due to their heat absorbing effects. In fact, it has been found that this effect can reduce the light output efficiency by as much as 10 to 15% when compared to lamps employing ignition structures which do not contain a glass bead or bead and sleeve, as separate elements within the lamp.

To provide the construction of FIG. 2, 7750 glass powder is heated and pressed into a doughnut shaped preform, or bead, which is slipped over the lead-in wires 18 and 20. The assembly is then rotated over the flame of a torch to fuse the glass bead to the wires to retain a spacing therebetween. While the bead is still in the plastic state from the fusing step, a blade is inserted between the pair of wires and pushed against the midpoint of the fused bead to stretch and displace the midportion 32 so that it protrudes toward the end of the pair of wires across which the filament is to be attached. Thereafter the 7720 glass envelope 10 is sealed about the 7750 glass bead 30 and the seal area 12 is pressed. As a result, the bead 30 of the finished lamp of FIG. 2 provides the multiple functions of (1) a graded expansion seal to permit the use of a low expansion glass envelope for improved containment; (2) isolation between the glass envelope and lead-in wires to permit the use of a lead-containing glass envelope with improved working characteristics; and (3) a means for preventing post-ignition short circuits between lead-in wires which permits the removal of beads and/or sleeves within the lamp envelope, thereby increasing the internal volume of a given envelope size and improving light output efficiency.

Although the invention has been described with respect to a specific embodiment, it will be appreciated that modifications and changes may be made by those skilled in the art without departing from the true spirit and scope of the invention.

What we claim is:

1. A photoflash lamp comprising:

an hermetically sealed envelope formed of a lead-containing glass having a first mean coefficient of thermal expansion;

a quantity of combustible material located within said envelope;

a combustion-supporting gas in said envelope;

an ignition structure disposed in said envelope in operative relationship with respect to said combustible material, said ignition structure including a pair of spaced apart lead-in wires sealed in one end of said envelope and a filament connected across said lead-in wires, said lead-in wires having a second mean coefficient of thermal expansion which is higher than said first mean coefficient;

and means for sealing said lead-in wires in said end of said envelope comprising a body of glass sealed between said lead-in wires and said envelope and supporting said wires in a spaced side-by-side relation, said body of glass having a third mean coefficient of thermal expansion which is intermediate said first and second mean coefficients.

2. A lamp according to claim 1 wherein said first mean coefficient of thermal expansion is about $36 \times 10^{-7}$ per °C between 0°C and 300°C.

3. A lamp according to claim 2 wherein said envelope is composed of a glass comprising the following constituents about in the proportions stated by weight: 73% $SiO_2$, 2% $Al_2O_3$, 15% $B_2O_3$, 4% $Na_2O$ and 6% PbO.

4. A lamp according to claim 2 wherein said second mean coefficient of thermal expansion is about $50 \times 10^{-7}$ per °C between 25°C and 300°C.

5. A lamp according to claim 4 wherein said lead-in wires are composed of a metal alloy comprising iron, nickel and cobalt.

6. A lamp according to claim 4 wherein said third mean coefficient of thermal expansion is about $40.5 \times 10^{-7}$ per °C between 0°C and 300°C.

7. A lamp according to claim 6 wherein said body of glass having said third mean coefficient of thermal expansion has a composition comprising the following constituents about in the porportions stated by weight: 68% $SiO_2$, 2% $Al_2O_3$, 26% $B_2O_3$, 0.5% $Li_2O$, and 3.5% $Na_2O$ and/or $K_2O$.

8. A lamp according to claim 6 wherein said body of glass having said third mean coefficient of thermal expansion comprises a preformed bead of pressed and sintered glass powder, said bead being sealed about said lead-in wires, and said end of said glass envelope being sealed about said bead.

9. A lamp according to claim 1 wherein the proportion of lead contained in the glass of which said envelope is formed is on the order of about 1 to 6 percent by weight.

10. A lamp according to claim 1 wherein said body of glass having said third coefficient of thermal expansion is shaped between said lead-in wires to protrude toward said filament for preventing post-ignition short circuits between said wires.

11. A lamp according to claim 10 wherein said body of glass is in the form of a bead distorted in the middle to protrude toward said filament.

12. A lamp according to claim 8 wherein the midportion of said preformed bead between said lead-in wires is stretched to protrude toward said filament for preventing post-ignition short circuits between said wires.

13. The lamp of claim 12 wherein said ignition structure further includes beads of primer located on the inner ends of said lead-in wires at the junction between the lead-in wires and the filament.

* * * * *